United States Patent [19]

Breitscheidel et al.

[11] Patent Number: 4,603,852

[45] Date of Patent: Aug. 5, 1986

[54] MAT FOR SPORTS AND ATHLETICS

[75] Inventors: Hans-Ulrich Breitscheidel, Siegburg; Rudolf Kautz, Hennef, both of Fed. Rep. of Germany

[73] Assignee: Dynamit Nobel Aktiengesellschaft, Fed. Rep. of Germany

[21] Appl. No.: 538,785

[22] Filed: Oct. 4, 1983

[30] Foreign Application Priority Data

Oct. 4, 1982 [DE] Fed. Rep. of Germany ..... 3236633

[51] Int. Cl.[4] ..... A63B 5/02; B32B 3/26

[52] U.S. Cl. ..... 272/109; 5/420; 5/481

[58] Field of Search ..... 272/101, 100, 109; 5/417, 420, 481; 156/211; 428/60, 120, 130, 192, 310, 315

[56] References Cited

U.S. PATENT DOCUMENTS

| | | | |
|---|---|---|---|
| 2,515,450 | 7/1950 | Hull | 5/417 |
| 3,268,922 | 8/1966 | Moxley | 5/481 |
| 4,147,828 | 3/1979 | Hecket et al. | 272/109 |
| 4,468,910 | 9/1984 | Morrison | 428/60 |

FOREIGN PATENT DOCUMENTS

| | | | |
|---|---|---|---|
| 174399 | 4/1935 | Austria | 5/361 |

*Primary Examiner*—Richard J. Apley
*Assistant Examiner*—S. R. Crow
*Attorney, Agent, or Firm*—Antonelli, Terry & Wands

[57] ABSTRACT

Mat for sports and athletics with a core layer made of an elastic foam material provided on the topside with a skin-compatible top material, for example, artificial leather or a textile material, and on the underside with a skidproof layer, wherein the side rims of the mat, starting with the core layer to the underside are continuously beveled, especially at 45°, and the top material is equipped with a border corresponding especially to twice the thickness of the mat and projecting beyond the topside, and wherein on the inside of the projecting border two especially equal-sized, wedge-like ridges are arranged so that they extend in parallel to the side of the mat in side-by-side relationship. These ridges have the cross-section of an isosceles right triangle and a height corresponding to half the thickness of the mat and are made of an elastic foam material. The projecting borders of the top material are extended with the ridges over the lateral surfaces to the underside of the mat, and the joint gaps are sealed, for example, by cementing or welding to provide a lateral border along the periphery of the mat.

20 Claims, 9 Drawing Figures

MAT FOR SPORTS AND ATHLETICS

This invention relates to a mat for sports and athletics, with a core layer of an elastic foam material provided on the topside with a skin-compatible top material, for example, artificial leather or a textile material, and on the underside with a skidproof layer.

Mats for sports and athletics with a core layer of foam material, for example, in the form of judo mats, gymnastic mats, hygienic mats, wrestlers' mats, athletics mats are known , for instance, from DOS (German Unexamined Laid-Open Application) No. 2,649,789; German Utility Model 7,621,838, or German Utility Model 7,806,307.

The objective in the manufacture of multi-ply athletic mats is in each case to provide adequate border protection along the lateral edges. In this connection, the procedure is usually such that either the top material is pulled downwards around the lateral edge, or the skidproof bottom layer is extended upwardly over the lateral edge. Both solutions exhibit the drawback that, in case of great loads exerted and, in particular, on the edges of the mats, the covering on the lateral edges will be detached or sharp-edged rims are produced which can lead to injuries to the athlete.

The invention is based on the object of providing, for the highly stressed rims of athletic mats, adequate, rugged border protection withstanding the high loads and enhancing the athletic goals.

In accordance with this invention, this object has been attained in a mat for sports and athletics, as regards edge protection, by providing that the lateral borders of the mat, starting with the core layer to the underside, are fashioned to be continuously beveled, especially at an angle of 45°, and the top material is equipped with a border having a width corresponding especially to twice the thickness of the mat and projecting beyond the topside, and two especially equal-sized, wedge-like ridges, ribs or sections, are arranged in side-by-side relationship in parallel to the side of the mat on the inside of the projecting border and bonded to the projecting border, these ridges having the cross-section of an isosceles right triangle and a height corresponding to half the thickness of the mat and being mde of an elastic foam material, the projecting borders of the top material being extended with the ridges over the lateral surfaces to the underside of the mat, and the joint gaps being sealed, for example, by welding or cementing. In this connection, it is especially advantageous for the top material to join the skidproof layer without an offset zone.

According to the invention, a border is produced along the mat which is continuously closed by the layer extended around the upper and lower borders of the mat, so that detachment along the rim due to loads is avoided in any event. Furthermore, the solution of this invention has the advantage that the borders are fashioned to be slightly rounded, thus reducing the danger of injuries. Another advantage resides in the smooth, flat transition on the bottom side from the top leather to the skidproof layer, wherein no offset zones are produced. The connection and joining zones are, in particular, glued or welded together along their full surface areas whereby the stability in the border zone is likewise ensured. The mats can be fashioned with smooth, rectangular lateral surfaces, making it possible to place individual mats perfectly in abutting relationship to form large areas.

The ridges forming the joint in the corner zone can be of various configurations. One advantageous embodiment provides a mirror-image symmetrical arrangement of the ridges in the corner region in such a way that a butt joint is formed as a miter joint. In this case, the inner ridges terminate at a right angle in the corner zone while the outer ridges are beveled at 45° at the end faces.

For those cases of application wherein a miter joint is not desired, it is also possible, using the present invention, to displace the joint in the corner zone to the lateral rim. For this purpose, the invention proposes to recess the ridges in the corner zone asymmetrically in such a way that the joint gap, in the extension of a folded-over border, runs toward the upper corner at an angle of 45° over a lateral edge of the mat.

Depending on the usage for the mat, the core layer can consist of plies of foam material made of crosslinked polyolefin foam panels of the same or a different weight per unit volume, the foam panels being preferably bonded by flame laminating. Wrestlers' mats, for example, have a size of $2\times1$ m with a height of 50 mm, and can be built up of five foam panels, for example, with a thickness of 10 mm and a weight per unit volume of 30 $kg/m^3$ as the core layer. Judo mats, however, must be made to be somewhat more rigid and can be composed, for example, of an upper core layer ply of crosslinked polyethylene foam with a weight per unit volume of 50 $kg/m^3$ with a thickness of about 12 mm; of a subsequent layer made up of a viscoelastic, crosslinked polyethylene foam panel with a weight per unit volume of 100 $kg/m^3$ and a thickness of 5 mm; and two lower plies of crosslinked polyethylene foam with a weight per unit volume of 30 $kg/m_3$ and a thickness of, respectively, 10 mm.

The skidproof layer is advantageously constituted by a soft polyurethane foam sheet, reinforced, if desired, with a flat textile support and with an optionally embossed surface having a thickness of about 0.5–3 mm, this layer being joined to the core layer especially by laminating, for example by flame laminating. A preferred version of the top material provides for an artificial leather sheet based on plasticized polyvinyl chloride with a thickness of about 0.3–1 mm, which can be bonded to the core layer, depending on the nature of the foam material in the core layer, by means of laminating or by means of adhesion promoters or adhesives.

The mat of this invention and a manufacturing process therefor will be explained in greater detail hereinafter with reference to the drawings wherein.

Figure 1:
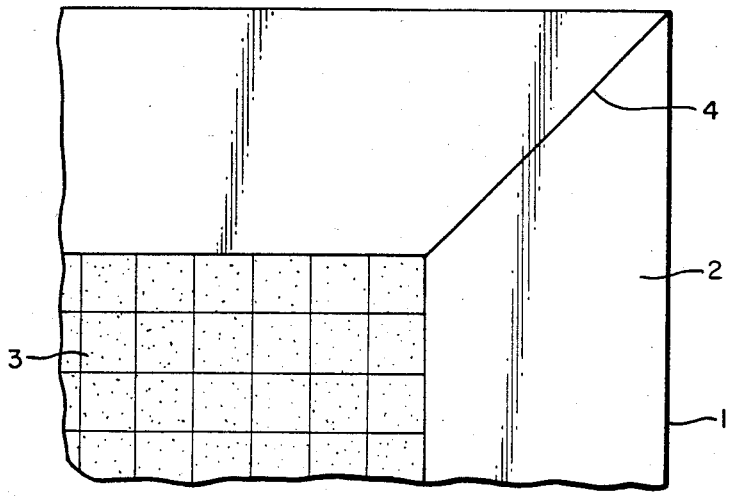
FIG. 1 shows a fragmentary bottom view of an athletic mat.

FIG. 1 shows a mat 1 in a bottom view, and illustrates how the top material extended over the lateral edges of the mat from the top toward the bottom runs along the underside of the mat as a folded-over border 2 and adjoins the skidproof bottom layer 3. The joints 4, cut to a miter, are glued or welded together, for example, and are optionally additionally sealed. According to the material of the top material, i.e., preferably PVC, the joints 4 are sealed preferably by solution welding.

Figure 4:
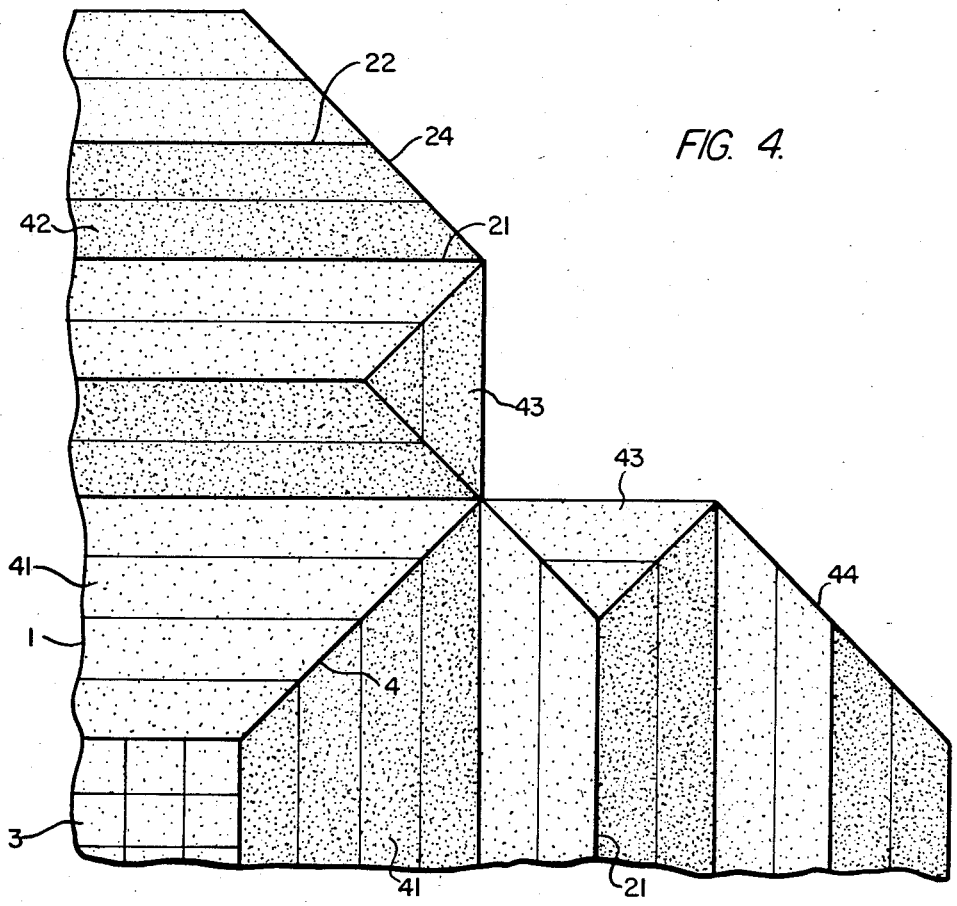
FIG. 4 shows a top view of the unfolded mat according to FIG. 2.
Figure 2:
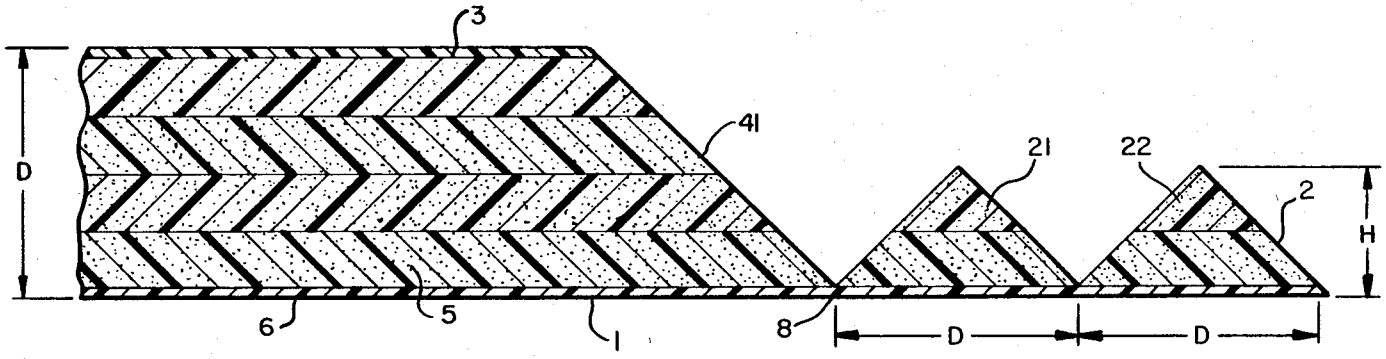
FIG. 2 shows a cross-sectional view of part of the mat with the border being unfolded.

FIG. 2 shows a partial cross-section through the mat with the border not yet folded inwardly and in contact with the layer 3. The core layer 5 of an elastic foam material can be made by compacting from elastic foam chips, or it can be formed of laminated-together foam panels, having the desired thickness and corresponding weight per unit volume. The core layer 5 is joined to the skidproof layer 3, for example, a soft polyurethane foam sheet, by means of flame laminating and is covered thereby to provide the underside of the mat 1. The topside of the mat 1 is provided by a skin-compatible top material layer 6, for example, of artificial leather which, depending on the material, which is adhesively bonded to the core layer 5 by flame laminating, laminating, optionally by means of adhesion promoters. The sides of the core layer are beveled from the topside toward the bottom side whereby the oblique surfaces 41 are produced. The top material layer 6 is extended past the rim 8 of the mat with a length corresponding approximately to twice the thickness of the mat. Wedge-shaped ridges or sections 21, 22 are bonded on a projecting border 6*a* of the top material in such a way that, in the joined condition, they form a rectangular corner along the sides of the mat, recessed by the oblique configuration, again into a full rectangle. Preferably, the wedge-shaped ridges, 21, 22, usually made up of the same material as the core layer 5, exhibit a height H corresponding to about half the thickness D of the mat 1 and are fashioned as isosceles right triangles wherein the base, respectively, corresponds in its length approximately to a mat thickness D. FIG. 4 shows, in a view from the bottom, the construction of the mat 1 with the ridges 21, 22 extending in parallel toward the sides, these ridges being recessed in the corner zone so that they form a closed, rectangular corner after joining. In this connection, the end faces 43 of the inner ridges 21 are fashioned to be correspondingly beveled; the end faces 44 of the outer ridges 22 extend, in the miter zone of the joint 4, vertically and at an angle of 45° with respect to the joint 4. The configuration of the mat 1 provided according to FIGS. 2 and 4, respectively, with foldable borders 6*a* can be produced, for example, by making the bevel 41 and the remaining ridges 21, 22 of a solid layer material by a shaping cut, for example with a band cutter or cutting wire or a saw wire, cutting the edge profiling out of the solid core layer material.

Figure 3:
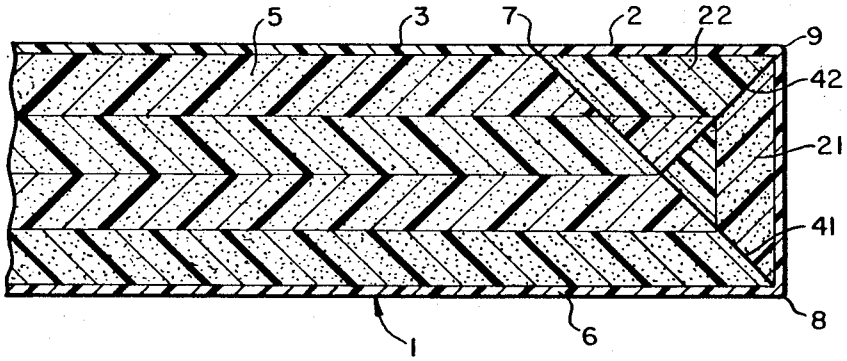
FIG. 3 is a cross-section through the mat of FIG. 1 with the border being folded together.

FIG. 3 illutrates the finished mat with folded-in edge zone and fastened edge zone. The joining surfaces 42 41 and the faces along the abutting edges 7 between the top material and the bottom layer, and the surfaces in the miter zone of joint 4 (see FIG. 1), are either glued and/or welded together. The outer rim of the joint can be additionally sealed. The mat 1 with the folded-over border according to FIG. 3 shows a top covering 6 continuous in the entire lateral zone over the upper edge 8 and the lower edge 9 of the mat, thus producing an extraordinarily rugged and also physically correct and athletics-enhancing mat. In particular, the top edge 8 is made to be slightly rounded by the arrangement of this invention and, thus, is particularly adapted to the function of the mat. With the folded-over border formed in accordance with this invention, and with the layer of top material extended to the underside, a homogeneous edge formation is also obtained which essentially exhibits the same elasticity also in the corner zone as in the central region of the mat. This ensures a uniform behavior of the mat even if combined with additional mats into a large area.

Figure 5:
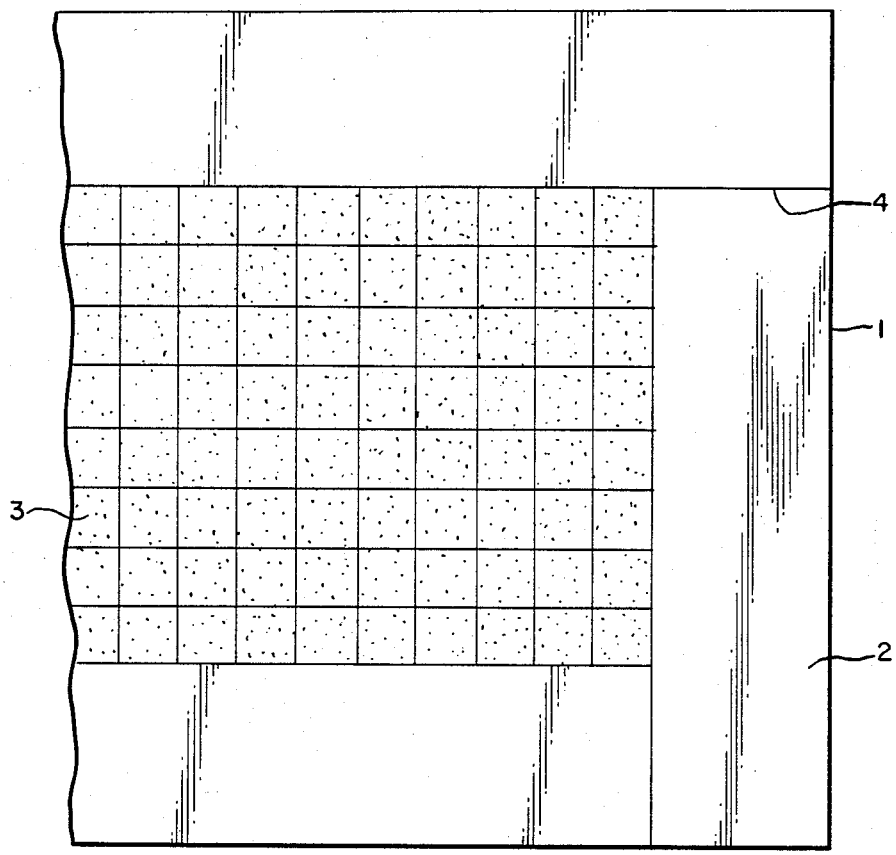
FIG. 5 shows a bottom view of a mat having a different joint configuration.
Figure 6:
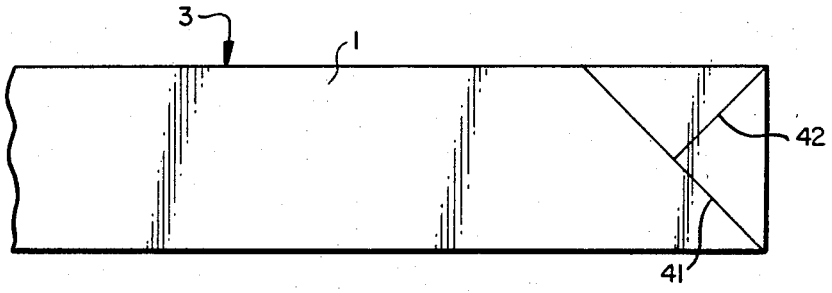
FIG. 6 shows a lateral view of the mat according to FIG. 5.

The mat of FIG. 5 shows, in a partial bottom view, how the top material extended from the top to the bottom runs as a folded-over border 2 continuously along the underside of the mat and adjoins the nonskid layer 3. However, in this case, no miter joint is provided, but rather a joint extending at a right angle toward the lateral edges and then, according to FIG. 6, at an angle of 45° along the lateral edges toward the upper corner; see face line 41. The two folded-in ridges then form the additional joint zone 42 along the side.

Figure 7:
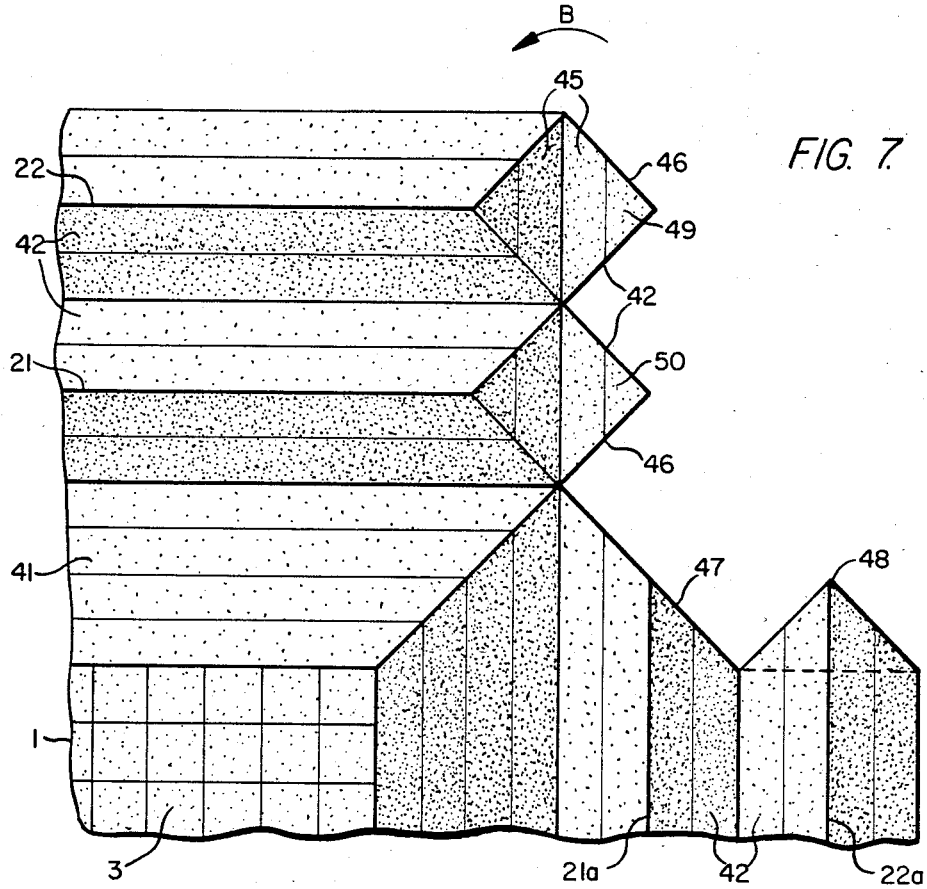
FIG. 7 shows a top view of the unfolded mat according to FIG. 5.

FIG. 7 shows in a partial, elevational view the configuration of the mat in the unfolded condition as seen in a bottom plan view of the mat shown in FIG. 5. The mat 1 is beveled at 45° along the lateral rims and forms the oblique lateral faces 41.

In extension, the foldable border is formed with the ridges 21, 22 and 21*a*, 22*a*, having the same cross-section as illustrated, for example, in FIG. 2. Only in the corner zone there is a different configuration of the end faces of ridges 21, 22, 21*a*, 22*a*, in order to make it possible to form a joint 4 extending outside of the miter. In this case, the ends of the ridges 21, 22 are fashioned with foldable tetrahedrons 49, 50 which, in the condition folded upwards in the direction of arrow B, complete the ridges 21, 22 into a rectangle, as can be seen for example, from the illustration of FIG. 9. The underside of the tetrahedrons 49, 50 is again covered with top material.

Figure 9:
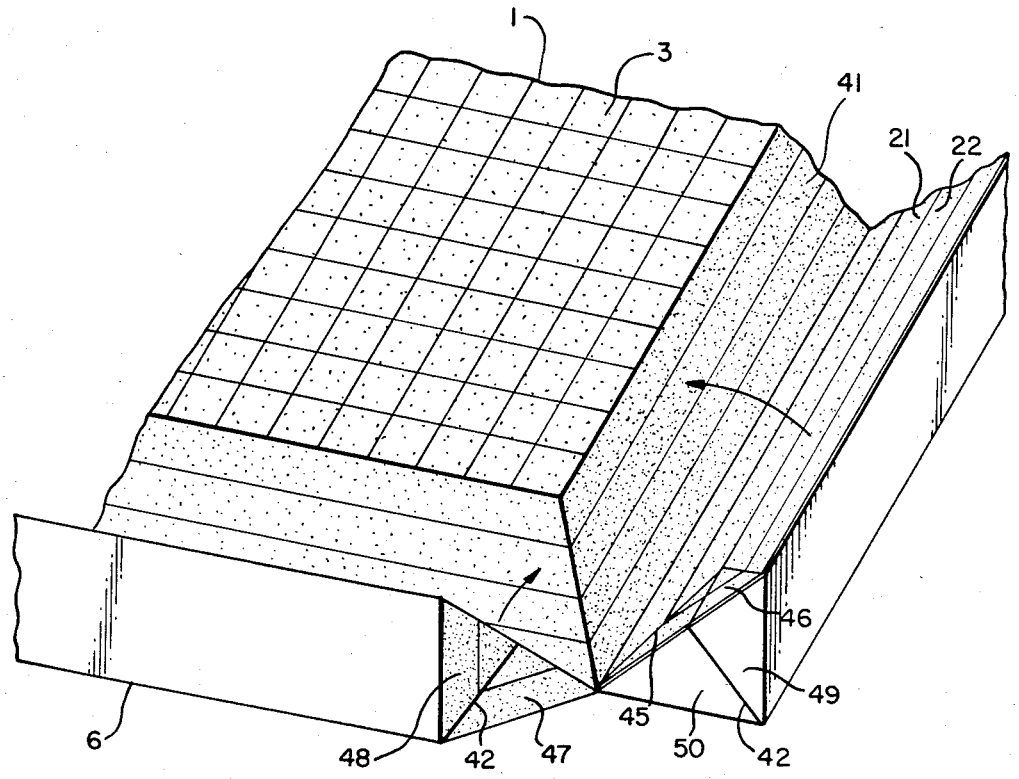
FIG. 9 shows a perspective view A of the mat according to FIG. 8.

The ridges 21*a*, 22*a* terminate in the corner zone in such a way that they form the supplement to the end faces of the ridges 21, 22. In this arrangement, the ridge 21*a* terminates at a bevel of 45° and forms the end face 47, while the outer ridge 22*a* is formed with a projecting tetrahedron 48. FIG. 9 shows, in a perspective view, the border configuration in the half-folded condition, wherein the ridges 22, 22*a*, respectively, are already folded inwards. The end faces 47, 48 of the ridges 21*a*, 22*a* extend with the outer rim at an angle of 45° beyond the lateral edge of the mat, as shown with the joint 41 in FIG. 6. The ridges 21, 22 then cover the corner zone.

Figure 8:
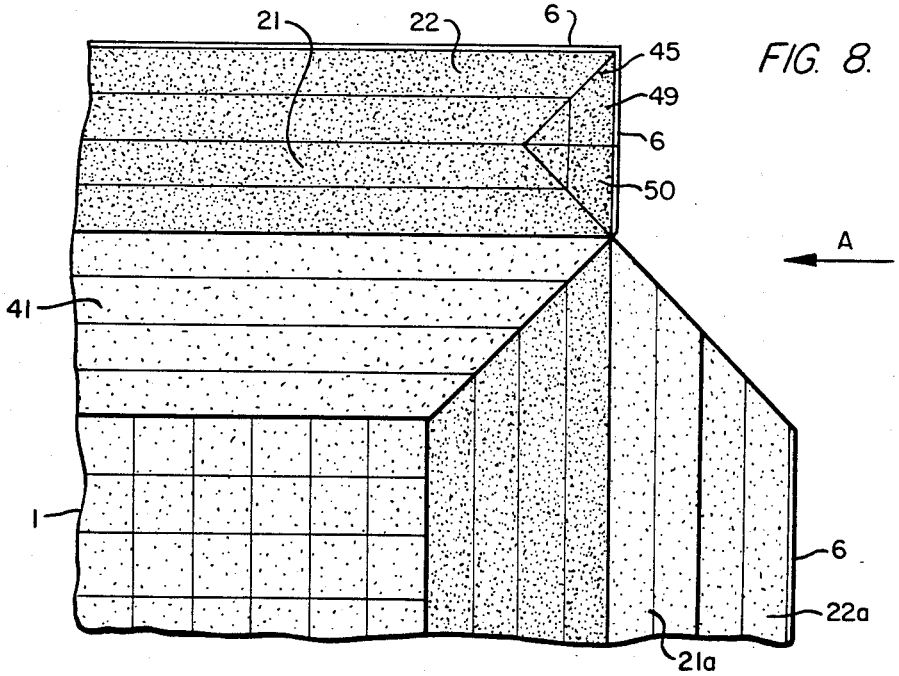
FIG. 8 shows a top view of a partially folded-in mat according to FIG. 7.

FIG. 8 shows, in an elevational view, again the half-folded condition as shown in perspective view once more in FIG. 9. The configuration of the ridges, as well as of the ends of the ridges constituting the corner follows geometrical complementary figures and can be produced, for example, by a shaping cut in the foam material. The starting base for the production of a mat with a folded-over border according to this invention is, for example, a layered material which is cut to size in accordance with the mat, plus the border widths.

What is claimed is:

1. A mat for sports and athletics which comprises a core layer made of an elastic foam material provided on the topside with a skin-compatible top material and on the underside with a skidproof layer, the core layer having side rims extending from the top side to the underside which are continuously beveled, and the top material being provided with projecting border portions having a width corresponding to twice the thickness of the mat and projecting beyond the topside of the core layer; on the inside of the projecting border portion two equal-sized, wedge-like ridges for forming the lateral border are arranged side-by-side and bonded to the projecting border portion and extend in parallel to the side of the mat, said ridges having the cross-section of an isosceles right triangle, a height corresponding to half the thickness of the mat and being made of an elastic foam material; and the projecting border portions of the top material being extended with the ridges over the surfaces of the side rims to the underside of the mat, and the resulting joint gaps are sealed whereby the lateral border is produced along the periphery of the mat.

2. A mat according to claim 1, wherein the core layer is laminated of plies of foam panels made of crosslinked polyolefin foam materials of the same or a different weight per unit volume.

3. A mat according to claim 1, wherein the nonskid layer comprises a soft polyurethane foam sheet reinforced with a flat textile support and having an embossed surface and a thickness of about 0.5–3 mm; said layer being joined to the core layer by laminating with heat.

4. A mat according to claim 2, wherein the nonskid layer comprises a soft polyurethane foam sheet reinforced with a flat textile support and having an embossed surface and a thickness of about 0.5–3 mm; said layer being joined to the core layer by laminating with heat.

5. A mat according to claim 1, wherein the top material comprises an artificial leather sheet based on plasticized polyvinyl chloride and has a thickness of about 0.3–1 mm, and is joined to the core layer by adhesion promoters.

6. A mat according to claim 2, wherein the top material comprises an aritifical leather sheet based on plasticized polyvinyl chloride and has a thickness of about 0.3–1 mm, and is joined to the core layer by adhesion promoters.

7. A mat according to claim 3, wherein the top material comprises an artificial leather sheet based on plasticized polyvinyl chloride and has a thickness of about 0.3–1 mm, and is joined to the core layer by adhesion promoters.

8. A mat according to claim 1, wherein the ridges are recessed in a corner zone in mirror-image symmetry so that a joint gap is fashioned as a miter joint.

9. A mat according to claim 2, wherein the ridges are recessed in a corner zone in mirror-image symmetry so that a joint gap is fashioned as a miter joint.

10. A mat according to claim 3, wherein the ridges are recessed in a corner zone in mirror-image symmetry so that a joint gap is fashioned as a miter joint.

11. A mat according to claim 4, wherein the ridges are recessed in a corner zone in mirror-image symmetry so that a joint gap is fashioned as a miter joint.

12. A mat according to claim 1, wherein the ridges are recessed in the corner zone asymmetrically in such a way that a joint gap runs in the extension of a folded-over border section at an angle of 45° over the lateral rim edge of the mat.

13. A mat according to claim 2, wherein the ridges are recessed in the corner zone asymmetrically in such a way that a joint gap runs in the extension of a folded-over border section at an angle of 45° over the lateral rim edge of the mat.

14. A mat according to claim 3, wherein the ridges are recessed in the corner zone asymmetrically in such a way that a joint gap runs in the extension of a folded-over border section at an angle of 45° over the lateral rim edge of the mat.

15. A mat according to claim 4, wherein the ridges are recessed in the corner zone asymmetrically in such a way that a joint gap runs in the extension of a folded-over border section at an angle of 45° over the lateral rim edge of the mat.

16. A mat according to claim 1, wherein the ridges are joined to an inner surface of the projecting border portion of top material by adhesion promoters.

17. A mat according to claim 1, wherein said core layer has a rectangular-shaped upper surface joined to the top material and a rectangular-shaped lower surface joined to the skidproof layer.

18. A mat according to claim 17, wherein the projecting border portions project from each of four upper edges of said core layer.

19. A mat according to claim 1, wherein the side rims of said core layer are planar surfaces beveled at an angle of 45°.

20. A mat according to claim 1, wherein the side rims of said core layer are beveled surfaces which contact corresponding beveled surfaces on said wedge-like ridges to provide said joint gaps.

* * * * *